US006799395B1

(12) United States Patent
Dabrowski et al.

(10) Patent No.: US 6,799,395 B1
(45) Date of Patent: Oct. 5, 2004

(54) HORIZONTAL DOOR LIFT

(75) Inventors: Gary P. Dabrowski, Naugatuck, CT (US); Roger F. Joyce, Guilford, CT (US)

(73) Assignee: The Bilco Company, West Haven, CT (US)

( * ) Notice: Subject to any disclaimer, the term of this patent is extended or adjusted under 35 U.S.C. 154(b) by 0 days.

(21) Appl. No.: 10/289,729

(22) Filed: Nov. 7, 2002

(51) Int. Cl.[7] ..... E05F 1/10
(52) U.S. Cl. ..... 49/386; 49/366; 49/397
(58) Field of Search ..... 49/386, 387, 397, 49/381, 366, 367; 16/289, 292, 374

(56) References Cited

U.S. PATENT DOCUMENTS

| | | | | | |
|---|---|---|---|---|---|
| 2,174,989 | A | | 10/1939 | Lyons | |
| 2,682,324 | A | | 6/1954 | Lyons | |
| 2,742,662 | A | | 4/1956 | Lyons | |
| 2,983,343 | A | * | 5/1961 | Lyons | 49/8 |
| 3,067,453 | A | | 12/1962 | Lyons | |
| 3,830,016 | A | * | 8/1974 | Levine | 49/8 |
| 4,104,761 | A | | 8/1978 | Lyons | |
| 4,873,791 | A | | 10/1989 | Lyons, Sr. | |
| 5,040,269 | A | | 8/1991 | Lyons, Jr. | |
| 5,927,012 | A | * | 7/1999 | Cermola et al. | 49/141 |
| 6,021,606 | A | * | 2/2000 | Kos | 49/386 |
| 6,378,848 | B1 | | 4/2002 | Uchida et al. | |
| 6,390,457 | B1 | | 5/2002 | Roper | |
| 6,394,566 | B1 | | 5/2002 | Slivon et al. | |
| 6,425,279 | B1 | | 7/2002 | Jeffries | |
| 6,431,332 | B1 | | 8/2002 | Phelizot | |

* cited by examiner

*Primary Examiner*—Jerry Redman
(74) *Attorney, Agent, or Firm*—DeLio & Peterson, LLC

(57) ABSTRACT

A horizontal door assembly is provided using a gas spring as a lifting mechanism for the door leaf. A special bracket having a number of pivot pin openings is employed to rotatably couple the gas spring to the door frame, whereby different lifting forces can be applied to the door by the user of the door by adjusting the position of the gas spring in the bracket. A brace is also provided to support the bracket and gas spring to enhance operation of the door. A resilient material such as EPDM is used to decelerate movement of the door leaf to the open position and provide a stable door leaf when in the open position. Sections of the door assembly are provided with screw studs to facilitate on-site construction and packaging and shipping of the door assembly.

8 Claims, 10 Drawing Sheets

HORIZONTAL DOOR LIFT

BACKGROUND OF THE INVENTION

1. Field of the Invention

The present invention relates to horizontal hinged doors such as cellar, bulkhead or hatchway doors and, in particular, to the use of a gas cylinder as a lifting mechanism in which the lifting force of the gas cylinder is easily adjustable by the user of the door using a specially designed bracket which rotatably couples the gas cylinder to the door leaf and to the use of braces to control the concentrated force exerted by the gas spring which force is potentially damaging to the door assembly. Components of the door assembly are also preferably provided with studs to facilitate handling and shipping and on-site construction by the installer.

2. Description of Related Art

There are numerous applications in which the hinge line for a door or other object is non-vertical. Such applications include, among others, hatch covers for roof openings, flush-mounted sidewalk doors, and, as illustrated here, the entrance doors for exterior basement entrances. Because the hinge line is at least partially horizontal in such applications, the weight of the door must be supported until the center of mass of the door is raised over the hinge line.

Doors of the type described are often quite heavy and can be dangerous due to the tendency to close rapidly and with great force when released. Accordingly, it has long been the practice to counterbalance the door, not only for increased safety, but also to permit the door to be opened and closed more easily with less force. For convenience, the following description will be directed to cellar doors although it will be appreciated by those skilled in the art that the invention can be used on other horizontal doors.

As discussed in U.S. Pat. No. 4,873,791, assigned to the assignee of the subject patent application, typically, the required counterbalancing torque is derived from torque rods, springs, or gas cylinders. Torque rods are noted to have a particular advantage that they provide the counterbalancing torque as a result of the rotation of one end of the rod relative to the other and the appropriate selection of the torque rod dimensions have provided a simple means for partial counterbalancing of the door. Torque rods are also noted to have the advantages that their long thin shape can be positioned out of the way behind the doorframe and they are extremely rugged and reliable.

While the use of the torque rods are very advantageous and used throughout industry for this type of door, there is a need to provide a door that would be beneficial to both the user such as a homeowner and to the installer for simplifying the installation process. The new door would be easier to use and adaptable to different lifting forces and will have increased resistance to vibration and rattling due to the effect of high winds.

Bearing in mind the problems and deficiencies of the prior art, it is therefore an object of the present invention to provide a horizontal hinged door assembly and, in particular, a cellar door assembly using a gas spring to assist opening and closing the door wherein the lift forces needed to lift the door can be easily adjusted without tools or training.

It is another object of the present invention to provide horizontal hinged doors which are constructed with sidewalls and horizontal hinged doors that use existing foundation sidewalls which doors are fabricated using a gas spring as a lifting device.

A further object of the present invention is to provide a horizontal hinged door which decelerates the movement of the door leaf during opening of the door and firmly supports the door without the need of an additional hold-open device and allows the user to close the door leaf with one hand rather than two.

It is yet another object of the present invention to provide a horizontal hinged door comprising a number of sections which are assembled on the job site to form the door, which sections have assembly studs welded in the factory so that damage to the door during shipping is minimized and the door may be packaged in a smaller container for the cost effectiveness and convenience of shipping and handling.

Still other objects and advantages of the present invention will in part be obvious and will in part be apparent from the specification.

SUMMARY OF THE INVENTION

The above and other objects and advantages, which will be apparent to those skilled in art, are achieved in the present invention which is directed to, in a first aspect, a horizontal door comprising:

- a frame surrounding an opening, the frame having a flat surface and angular vertical sidewalls, the angular sidewalls preferably having inwardly turned foundation flanges at the base of the sidewall;
- one or more door leafs hinged to the frame for movement between an elevated open position and a closed position;
- a bracket mounted on the frame having one or more spaced through openings therein to accommodate a pivot pin;
- an elongated brace extending from the bracket to the foundation flange; and
- a pressure device having a rod rotatably coupled to a through opening in the bracket and a cylinder rotatably coupled to the door, the pressure device resiliently urging the door leaf to its open position.

In a further aspect of the invention, a horizontal door is provided comprising:

- a frame surrounding the opening, the frame having a flat surface and a downwardly extending flange plate running along the frame and having one or more through openings in the plate;
- one or more door leafs hinged to the frame for movement between an elevated open position and a closed position;
- a bracket mounted on the frame having one or more spaced through openings therein for accommodating a pivot pin and one or more communicating through openings that extend through the bracket and through the flange plate;
- a fastener passing through the through opening in the bracket and the flange plate and engaging the side of the opening; and
- a pressure device having a rod rotatably coupled to a through opening in the bracket and a cylinder rotatably coupled to the door, the pressure device resiliently urging the door to its open position.

In another aspect of the invention, various door assembly sections assembled on-site to make the horizontal door are provided with studs, preferably threaded, which studs are used by the installer to simply and easily fabricate the horizontal door and which studs enable packing the door assembly sections in a smaller package for cost effectiveness and convenience of shipping and handling.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–12B of the drawings in which like numerals refer to like features of the invention.

Figure 1:
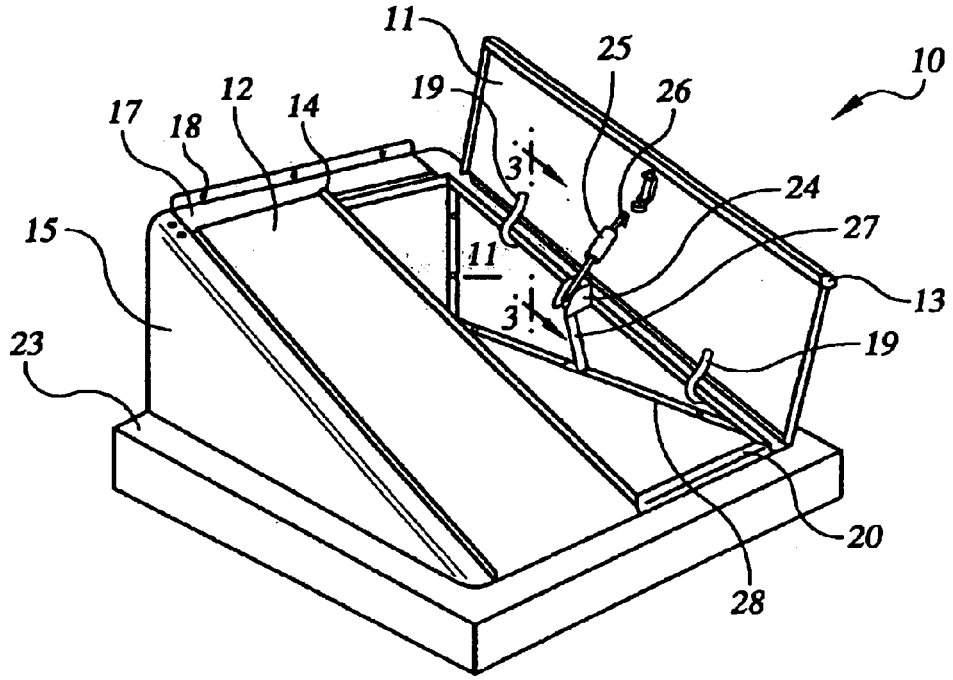
FIG. 1 is a perspective view of a cellar door of the invention having vertical angular sidewalls and showing the gas cylinder attached to the door leaf and a bracket and a brace extending from the bracket to the sidewall foundation flange.

Referring to FIG. 1, a door assembly of the invention having vertical angular sidewalls is shown generally as 10. The door 10 has a right door leaf 11 and a left door leaf 12. Right door leaf 11 has a bead 13, which, when the door leaf is closed, mates with lip 14 on left door leaf 12 to provide a seal. The door assembly has angled vertical sidewalls 15 and 16 which are connected to a header 17. Header 17 has a vertical flange 18 for securing to a wall or other such structure. A sill 20 is also connected to sidewalls 15 and 16 forming the door assembly frame. Gooseneck hinges 19 are used to open and close each door leaf. A foundation is shown as 23 and it is this foundation on which the door is secured by fastening sidewall flanges 28 to the foundation. Bolts or other similar fasteners are typically used to secure the flange to the foundation to secure the door.

A gas spring is shown generally as 25 and is rotatably coupled to a leaf bracket 26 on right door leaf 11 and to a sidewall bracket 24 which is fixedly secured to the sidewall 16. A brace 27 is shown extending from bracket 24 to the bottom sidewall flange 28 to provide support for the gas spring. If there is no flange 28, the base can be secured to the foundation 23 or sidewall 16. A sidewall vertical flange 29 (not shown) is likewise secured to the structure to which the door is secured.

Figure 2:
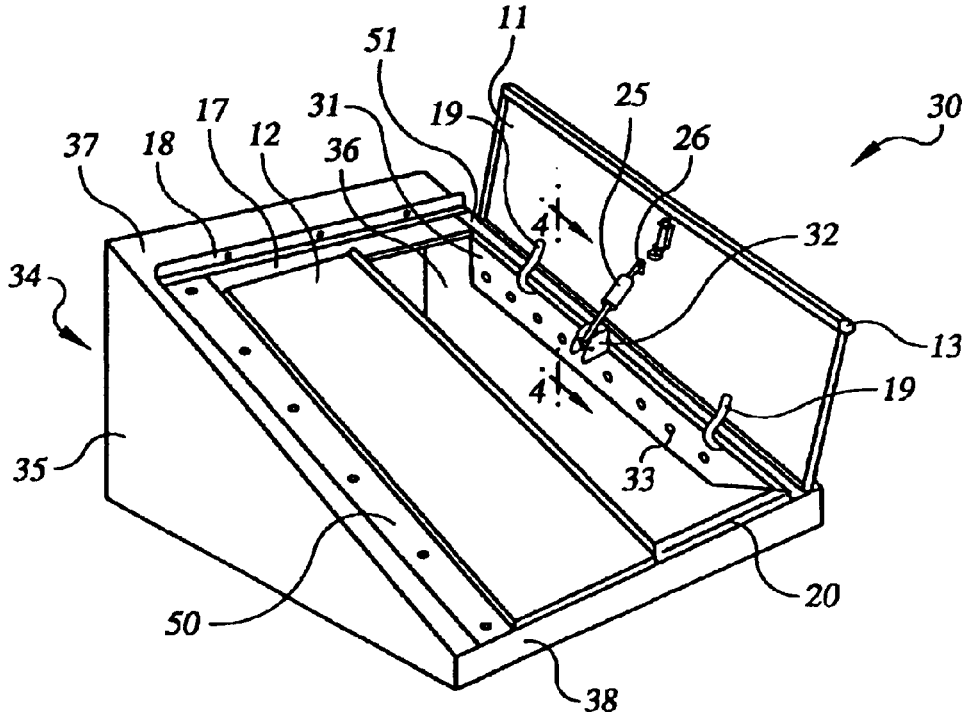
FIG. 2 is a perspective view of a cellar door of the invention which is installed on an existing angular foundation and shows a gas spring connected to the door leaf and a flange plate extending along the frame member of the door.

Referring now to FIG. 2, a sloped sidewall basement door is shown generally as 30. As in FIG. 1, the door 30 has a right door leaf 11 and a left door leaf 12. The door assembly 30 has a left side elongated flat plate 50 and a right side elongated flat plate 51 connected by a elongated flat plate header 17. The header 17 has an upwardly extending header flange 18 for water drainage. The side plates 50 and 51 and header flange 17 are connected to an angled foundation shown generally as 34 which comprises an angled left foundation wall 35, a right angled foundation wall 36 and a header foundation wall 37. The door assembly 30 has a vertical flat plate flange 31 extending along the length of the side plates 50 and 51 extending downwardly into the opening The flat plate 31 has a number of through holes 33 which are used to secure the plate to the foundation wall. A gas spring is shown generally as 25 and is rotatably coupled to door leaf 11 by leaf bracket 26 and to the flat flange plate 31 by bracket 32. Gooseneck hinges 19 are used to open and close each door leaf. A sill foundation is shown as numeral 38 and a sill, which is part of the door assembly, as numeral 20.

Figure 3A:
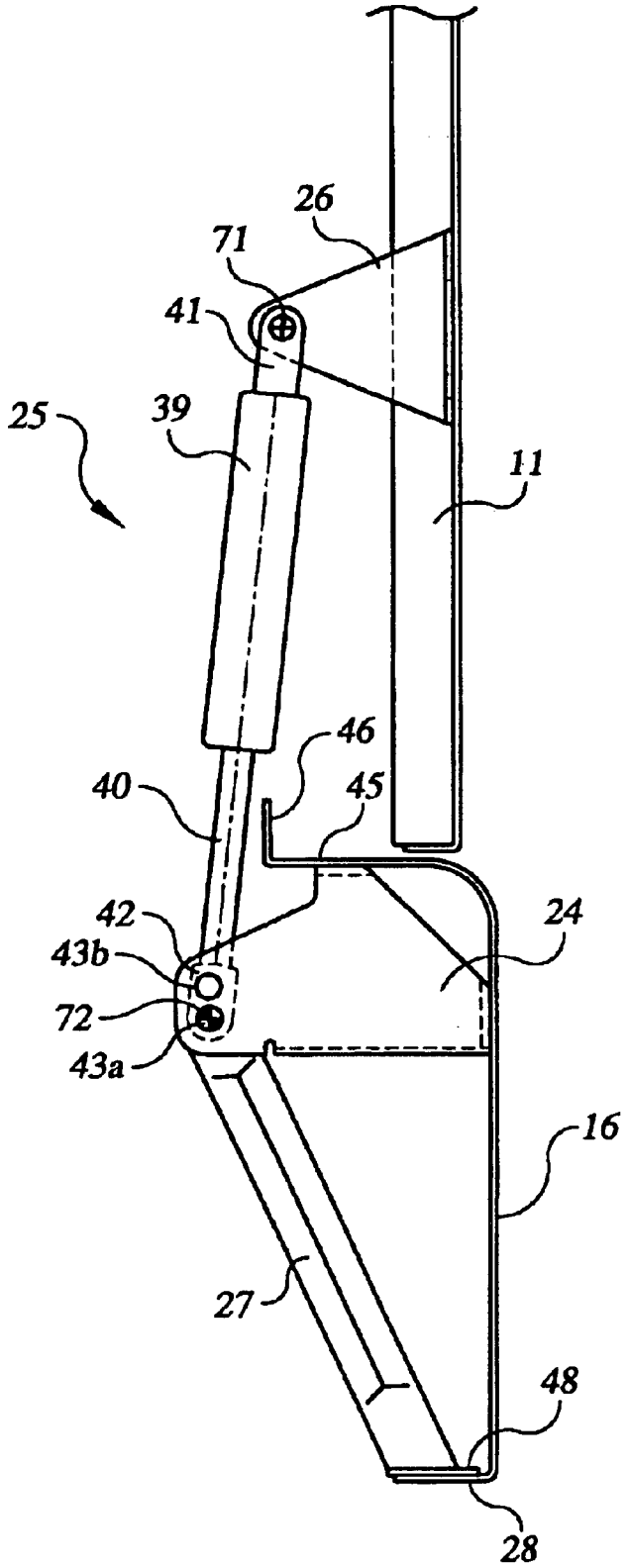
FIGS. 3A and 3B show, in sequence, movement of the door leaf of FIG. 1 from the open position to the closed position, respectively.
Figure 3B:
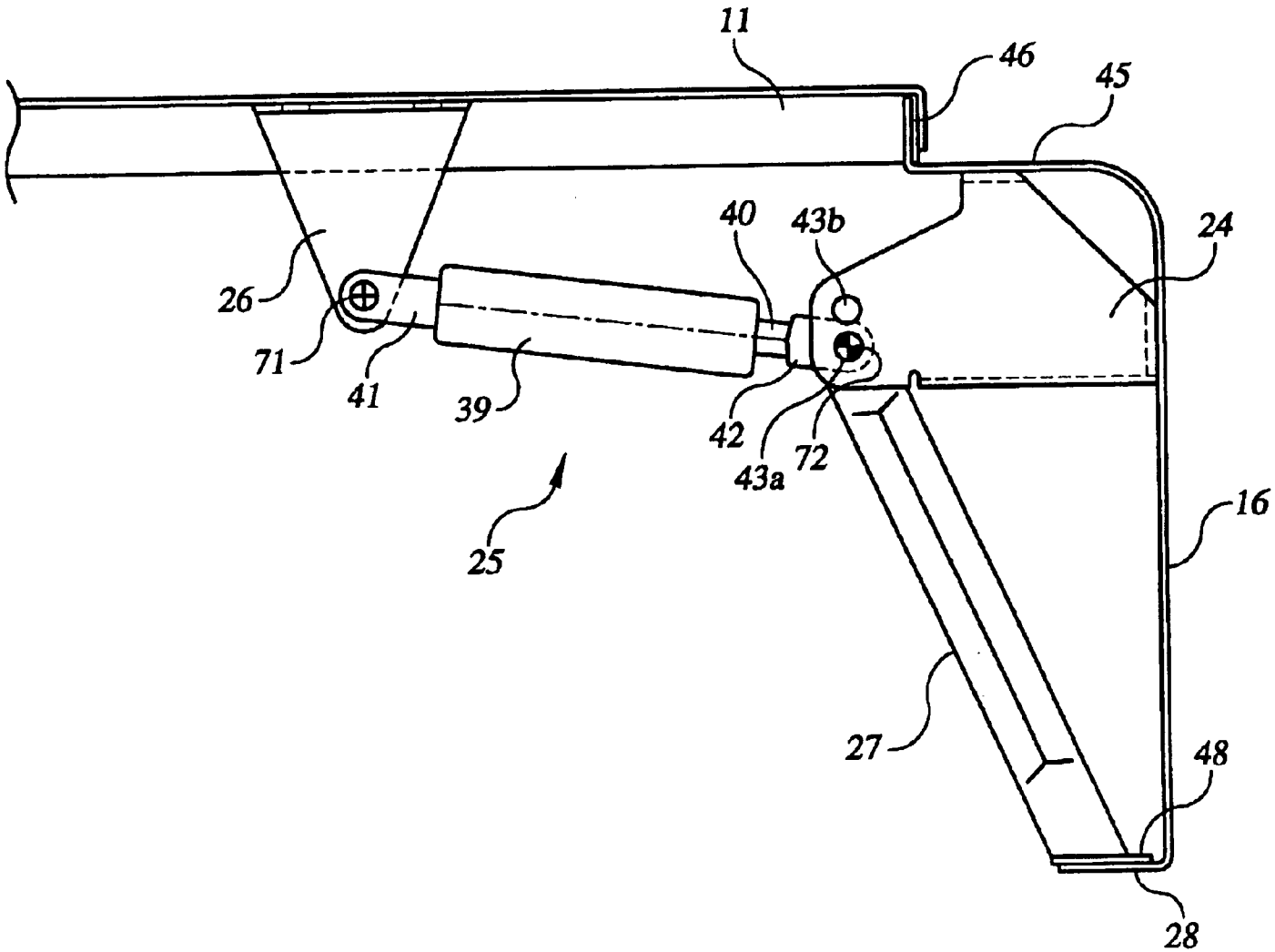

Referring now to FIGS. 3A and 3B, operation of the door may be demonstrated. The door leaf 11 has a leaf bracket 26 secured thereto to which is rotatably coupled mounting socket 41 of cylinder 39 of gas spring 25 by pivot pin 71. A rod 40 of the gas spring 25 has at the end thereof a rod-mounting socket 42 which is rotatably coupled in opening 43*a* of sidewall bracket 24 by pivot pin 72. The mounting sockets of the cylinder and rod can be reversed but is not preferred. As can be seen, another pivot through opening 43*b* is provided in sidewall bracket 24 for rotatably coupling the rod-mounting socket 42 to this opening. Use of this opening and other through openings changes the force of the gas spring and provides different opening and closing door leaf forces and which forces can be easily adjusted by the user of the door. One or more holes at various locations in the sidewall bracket 24 provide a simple means of lifting force adjustment. As shown, opening 43*a* would provide a standard lifting force whereas opening 43*b* provides a lower lifting force. Other holes can be used to provide additional and different lifting forces.

It can be appreciated that the user of the door can easily change the lifting force by simply removing the pivot pin and changing the hole to which the mounting socket 42 is attached.

A brace 27 is shown extending from sidewall bracket 24 to bottom sidewall foundation flange 28. The brace may extend from the bracket to the sidewall or foundation but extension to the foundation flange is preferred. It is an important feature of the invention to provide a brace which controls the force of the gas spring when the door is opened or closed as well as minimizing deleterious forces in the door leafs and sidewalls. The significant forces generated by the gas spring are directed through the brace 27 to the foundation as the brace is anchored through foundation flange 28. The frame of the door assembly is shown having a bottom foundation flange 28, a vertical sidewall 16, a horizontal upper surface 45 ending in a vertical sidewall flange 46 for water drainage.

Figure 9A:
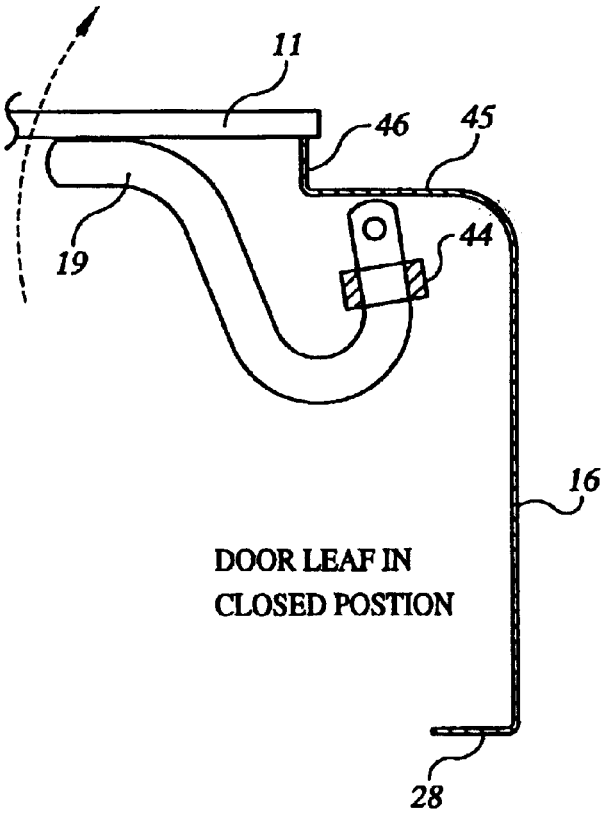
FIGS. 9A and 9B are cross-sectional side views of a cellar door of the invention in the closed and open positions, respectively, showing use of an elastomeric bumper (damper) to control movement, position and deceleration of the door leaf when the door leaf is opening.
Figure 9B:
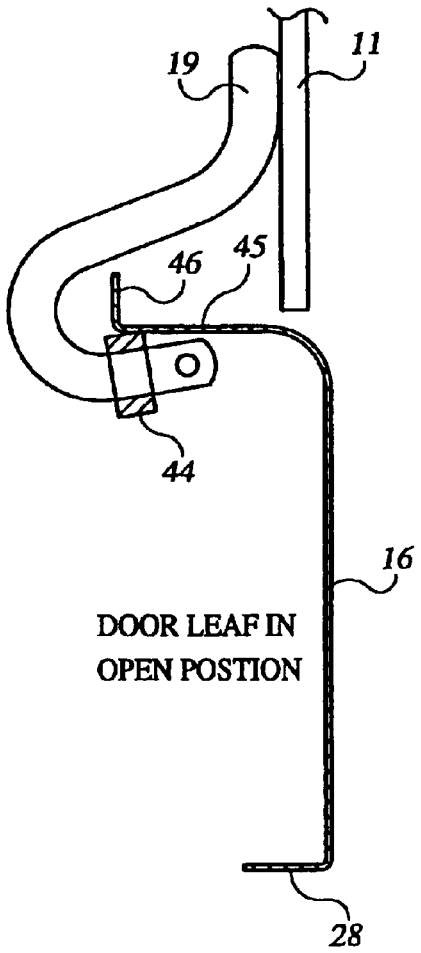
Figure 9C:
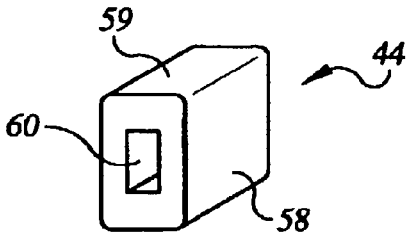
FIG. 9C is a perspective view of an elastomeric bumper used in FIGS. 9A and 9B.

It is another important feature of the invention that a bumper (or damper) 44 be used in conjunction with the hinge 19 of the door so that when the door leaf is opened, it rests against the lower side of horizontal upper surface 45 of the sidewall 16. Use of the bumper 44 in combination with the gas spring 25 has been found to decelerate the movement of the door and to firmly support the door leaf in the open position. A thickness up to about 1 inch or more, e.g., of about ⅝ to ⅞ inch may be used and a preferred bumper material is a terpolymer elastomer made from ethylene-propylene diene monomer (EPDM). Use of the bumper 44 may be seen in FIGS. 9A and 9B, which show the door leaf 11 in the closed and open position, respectively. FIG. 9C shows a preferred bumper 44 of the invention. The bumper 44 is elongated and has opposed sidewalls 58 and opposed top and lower surfaces 59. A through opening 60 fits around the hinge 19. As can be seen in FIG. 9B, the bumper 44 contacts the lower side of horizontal surface 45 and decelerates opening of the door leaf 11 and also stabilizes and supports the door in the open position.

Figure 4A:
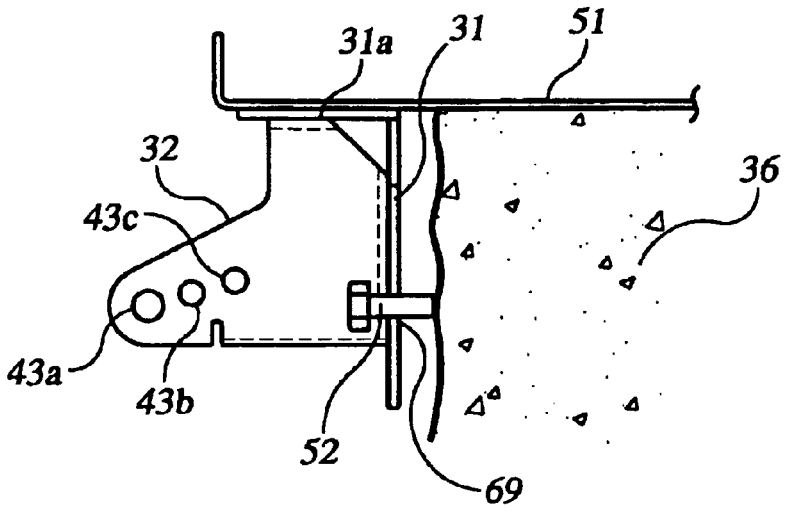
FIGS. 4A and 4B show a portion of the door of FIG. 2 secured to a foundation wall.
Figure 4B:
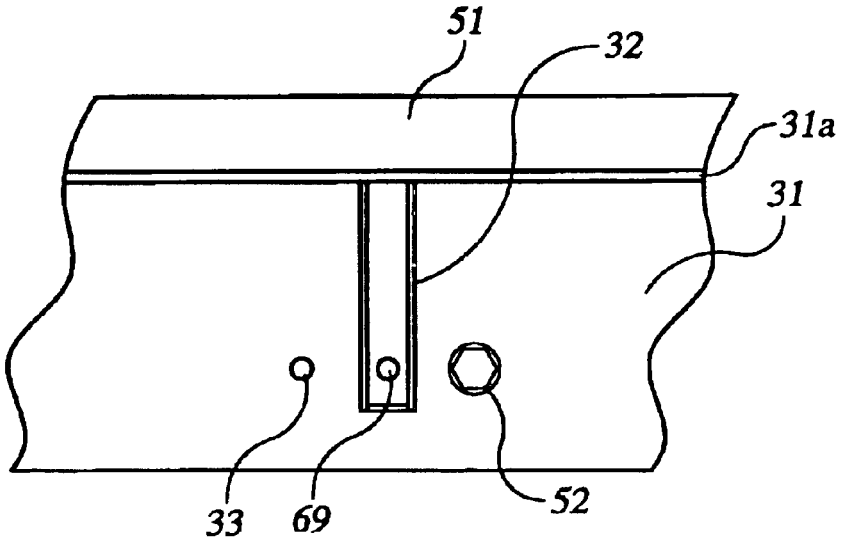

Referring now to FIGS. 4A and 4B, installation of a sloped sidewall basement door of FIG. 2 of the invention is shown. The elongated flat plate 51 of the door assembly rests on the foundation surface 36 and the vertical flat flange plate 31 is shown secured to the flat plate 51 by angled portion 31*a* and runs along the plate. A bracket 32 is shown attached to the plate 31 and angled portion 31*a* and this bracket 32 is used to accommodate the rod-mounting socket 42 of the gas spring as shown in FIG. 3A. As discussed above, a number of pivot pin openings 43*a*, 43*b* and 43*c* are provided in bracket 32 to change the position of the gas spring 25 to provide different lifting forces. A fastener 52 is shown extending through the communicating through opening 69 in bracket 32 and opening 33 in flange plate 31 and contacts or is secured in foundation wall 36 providing support for the bracket and gas spring. A number of through openings 33 may be provided in the plate 31 for providing additional support but it is preferred that at least one fastener 52 be secured through the opening 69 in the bracket 32.

Any suitable gas spring may be used and exemplary gas springs as shown in U.S. Pat. Nos. 6,378,848; 6,390,457; 6,394,566; 6,425,279; and 6,431,332, which patents are hereby incorporated by reference. A typical gas spring is sold by Stabilus Company, North Carolina. Gas springs for this application are engineered to provide the appropriate force for ease of operation for each size and weight of door leaf.

Generally speaking, gas springs include, among other components: a cylinder that defines an internal tubular cavity; a piston assembly reciprocally moveable within and dividing the tubular cavity into compression and extension working chambers; a shaft connected and moveable with the piston assembly, with one end of the shaft projecting out of an end of the tubular cavity; and end caps for closing the ends of the tubular cavity, with one of the end caps also including a seal for the reciprocally moveable shaft as it moves with respect to that end cap.

In normal gas spring operation, the piston assembly, and its projecting shaft, may extend or retract at a nominal rate due to the metering of the gas across the piston assembly.

Figure 5A:
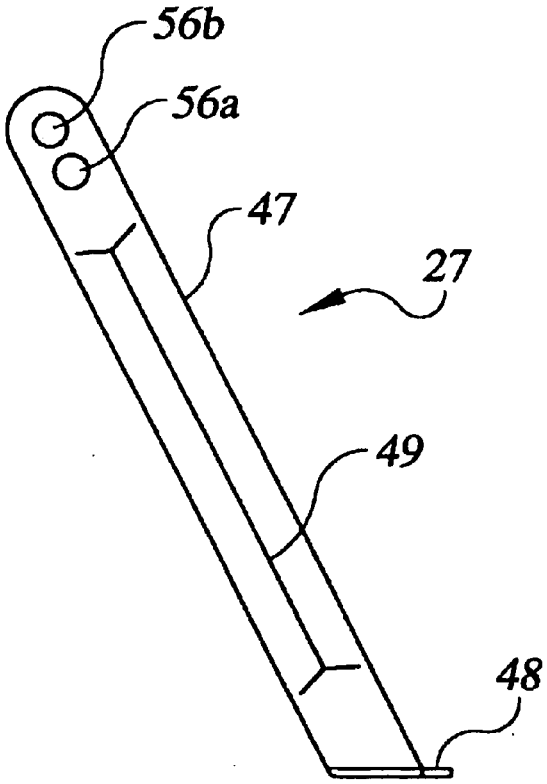
FIGS. 5A and 5B show an elevational view and a side view, respectively, of a brace used on a door of the invention as shown in FIGS. 1, 3A and 3B.
Figure 5B:
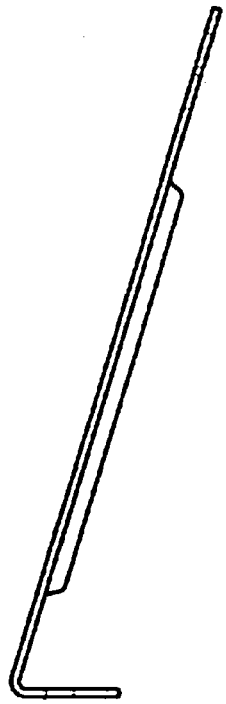

Referring now to FIGS. 5A and 5B, a brace used with the door of the invention is shown generally as 27. The brace comprises an angled longitudinal member 47 having an inward lower flange 48 and openings 56*a* and 56*b* for securing one or the other to one of the openings 43*a* and 43*b* in sidewall bracket 24 of FIG. 3A. Sectional displacement 49 is formed in order to provide enhanced stiffness to the brace. As can be seen from FIGS. 3A and 3B, the lower flange 48 is secured to sidewall foundation flange 28 and the upper end of the brace at opening 56*a* to opening 43*a* in sidewall bracket 24.

Figure 6:
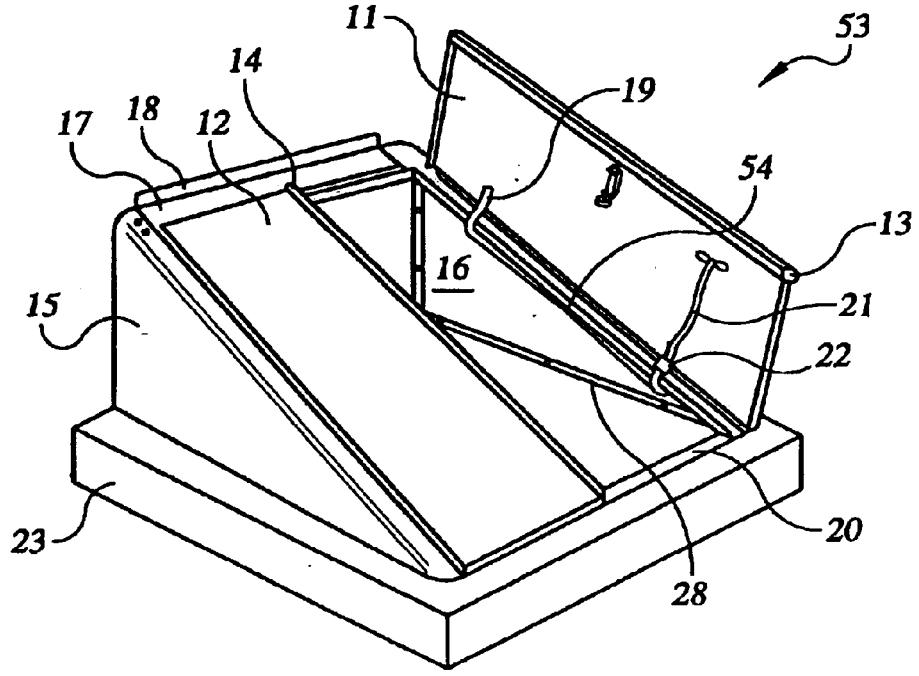
FIG.6 PRIOR ART
FIG. 6 shows a schematic view of a cellar door of the prior art having vertical sidewalls and torsion bars to control lifting of the door.

Referring to FIG. 6, a door of the prior art is shown generally as 53. The door is similar to the door as shown in FIG. 1 except that torsion bars 54 are used as the lifting mechanism.

Figure 7:
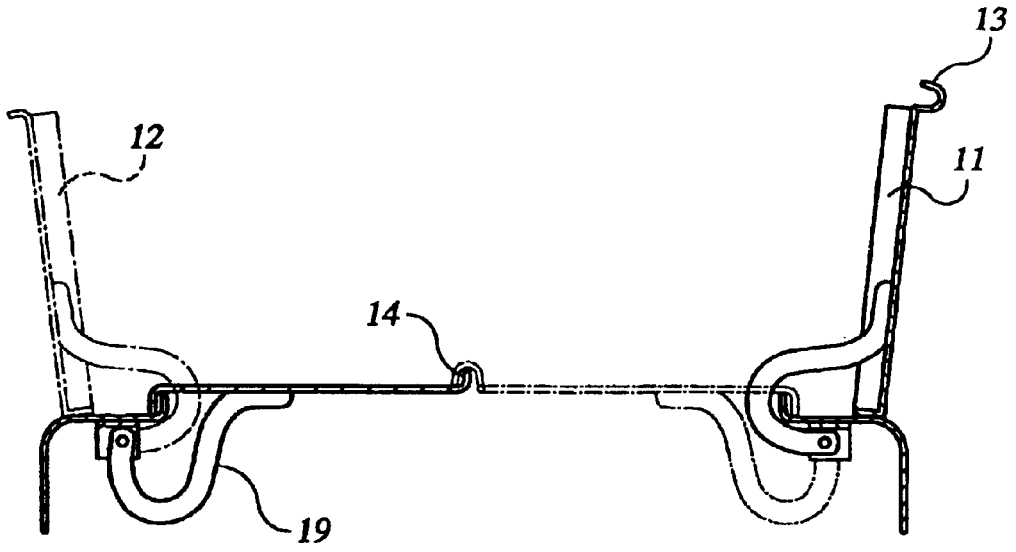
FIG.7 PRIOR ART
FIG. 7 is a cross-sectional view of the door of FIG. 6 showing the door leaves in open and closed positions.

FIG. 7 shows the prior art door of FIG. 6 in open and closed positions showing operation of hinges 19.

Figure 8:
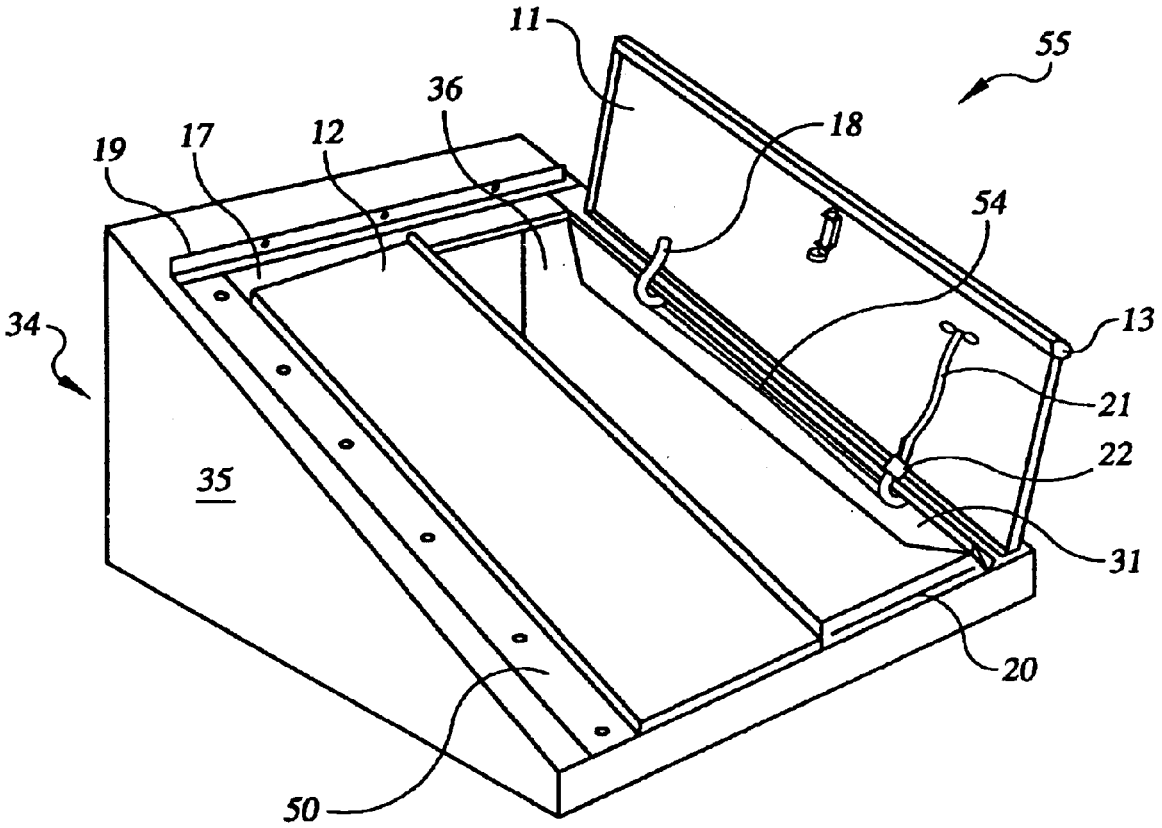
FIG.8 PRIOR ART
FIG. 8 is a schematic view of a cellar door of the prior art which is installed on an existing, sloped foundation and which uses torsion bars as a lifting mechanism.

FIG. 8 shows a sidewall basement door of the prior art generally as numeral 55. This door corresponds to the door of the invention as described above in FIG. 2 except that torsion bars 54 are used as the lifting mechanism.

Figure 10B:
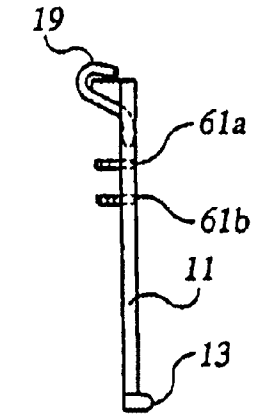
FIGS. 10A and 10B show an elevational view and a side view of a door leaf of the cellar door of the invention, respectively, having threaded studs for securing the gas spring bracket.
Figure 10A:
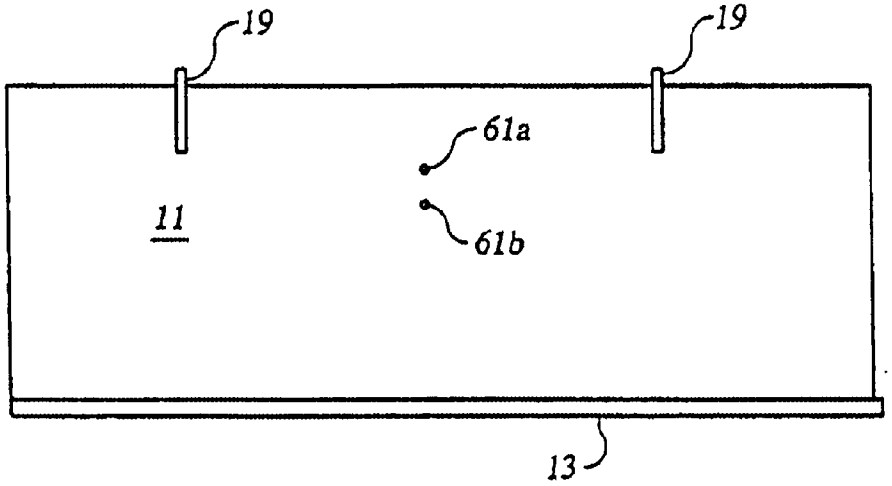

FIGS. 10A and 10B show an elevational view and a side view of a door leaf of the invention having threaded stud connectors for securing a leaf bracket 26 to the door leaf 11. Door leaf 11 has two threaded stud connectors 61*a* and 61*b* in the upper central part of the door leaf 11. A door leaf bracket 26 as shown in FIG. 3A would be secured to the door leaf using the connectors 61*a* and 61*b* and any suitable fastener such as a nut. The leaf bracket 26 may also be secured at the factory by welding but as noted above significant cost savings can be incurred in both manufacturing and packaging by using the connectors 61*a* and 61*b* of the invention.

Figure 11B:
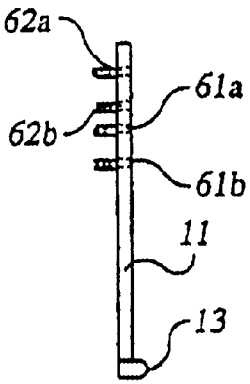
FIGS. 11A and 11B show an elevational view and a side view of a door leaf of a cellar door of the invention, respectively, having threaded studs for securing the gas spring bracket and the hinges to the door leaf.
Figure 11A:
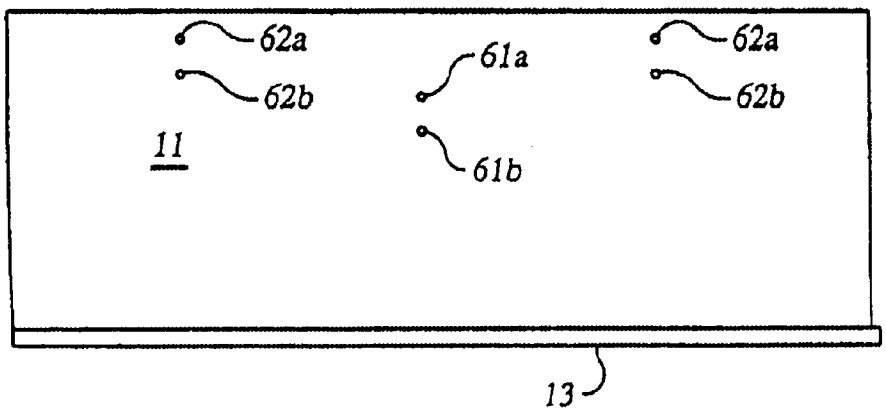

FIGS. 11A and 11B are preferred door leafs of the door assembly of the invention since they contain both threaded stud connectors to connect the gas spring leaf bracket 26 to the door leaf 11 as well as threaded stud connectors 62*a* and 62*b* for securing a hinge 19 to the door leaf. Typically, the hinges are secured to the door leaf by welding and the other pivot end of the hinge secured to the sidewall on the site. In this embodiment of the invention, the hinges would be secured to the door leaf on site using the connectors 62*a* and 62*b* as shown in FIGS. 11A and 11B.

Figure 12:
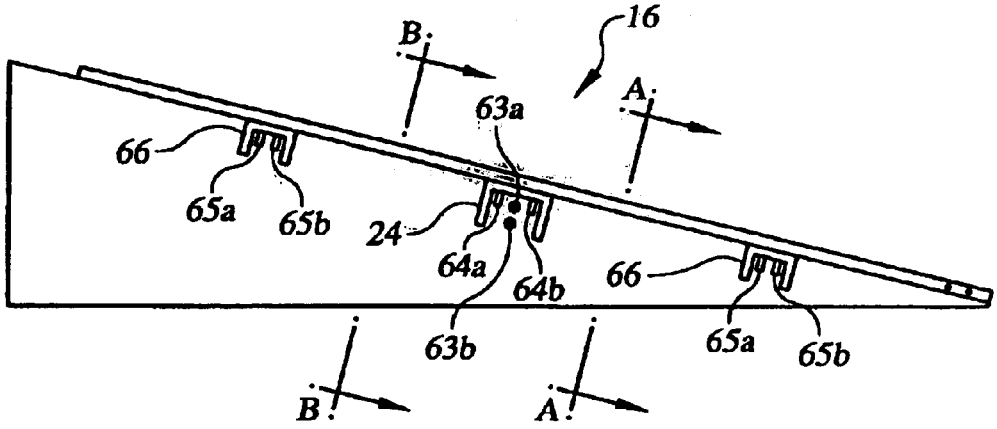
FIG. 12 is an elevational view of a sidewall of a cellar door of the invention having threaded studs for securing a gas spring bracket and hinge bracket to the sidewall.
Figure 12A:
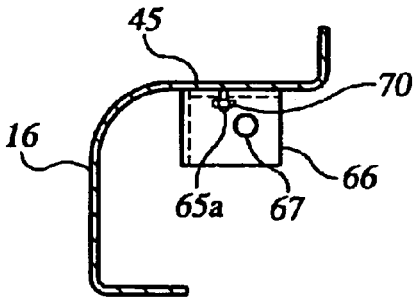
FIG. 12A is a sectional view along lines A—A of FIG. 12 showing the hinge bracket secured to the side wall using the threaded stud.
Figure 12B:
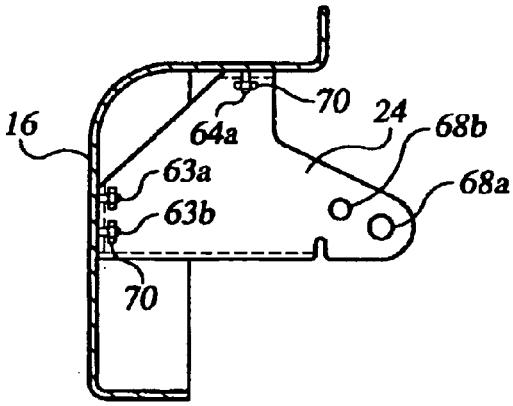
FIG. 12B is a cross-sectional view along lines B—B of FIG. 12 showing a gas spring bracket secured to the side wall using the threaded studs attached to the side wall.

FIGS. 12, 12A and 12B show a preferred sidewall 16 of the invention containing threaded stud connectors to secure the sidewall spring bracket 24 and sidewall hinge brackets 66. Thus, as shown in FIG. 12, threaded stud connectors 63*a* and 63*b* are transverse to the sidewall and studs 64*a* and 64*b* are vertical to the sidewall. The sidewall spring bracket 24 would be secured to the sidewall using the connectors with a fastener such as a nut 70. Likewise, vertical connectors 65*a* and 65*b* would be used to secure the sidewall hinge bracket 66 to the sidewall.

As shown in FIG. 12A, sidewall hinge bracket 66 is secured to the lower surface 45 of the sidewall using a threaded stud connectors 65*a* (65*b* not shown) and nut 70. An opening 67 is provided in the sidewall hinge bracket to rotatably couple the hinge to the bracket with a pivot pin.

Referring to FIG. 12B, the sidewall gas spring bracket 24 is secured to the sidewall using threaded stud connector 64*a*

(64*b* not shown) and threaded stud connectors 63*a* and 63*b* with nuts 70. The opening 68*a* in bracket 24 is used to rotatably couple the gas spring as well as for securing the brace to the gas spring bracket as shown in FIG. 3A. Opening 68*b* can also be used to change the gas spring force as described above.

It will be appreciated by those skilled in the art that there are a number of combinations for using threaded studs connectors for securing the hinge and hinge brackets and gas spring brackets to the sidewall and door leaf of the door assembly of the invention. In the most preferred embodiment, threaded studs connectors would be provided on both the door leaf and the sidewall for securing both the hinges and the gas spring brackets to the door assembly on-site. In another embodiment, hinges can be secured to the door leaf as in the prior art with threaded studs connectors provided in the door leaf and sidewall for securing the gas spring bracket to the door assembly. Other stud combinations may also be provided to facilitate manufacturing and packaging considerations.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A horizontal door assembly having one or more door leafs comprising:

a frame surrounding an opening, the frame having opposed vertical angular sidewalls connected by a header plate, the vertical angular sidewalls having a flat horizontal upper inwardly turned flange having an upper surface and a lower surface, an angular vertical sidewalls, and a bottom inwardly turned foundation flange;

one or more door leafs hinged to the frame by a hinge for movement of the door leaf between an elevated open position and a closed position;

a bracket mounted on the frame having one or more spaced through openings therein to accommodate a pivot pin;

an elongated brace extending from the bracket to the foundation flange; and a pressure device having a rod rotatably coupled to a through opening in the bracket and a cylinder rotatably coupled to the door leaf, the pressure device resiliently urging the door leaf to its open position.

2. The horizontal door assembly of claim 1 wherein a resilient bumper on the hinge rests against the lower surface of the upper flange of the sidewall when the door leaf is in the open position.

3. The horizontal door assembly of claim 2 wherein the bumper is EPDM.

4. The horizontal door assembly of claim 1 wherein the door leaf or the sidewalls have studs for securing the hinges or brackets thereto.

5. A horizontal door assembly having one or more door leafs comprising:

a frame surrounding an opening having opposed vertically angled foundation sidewalls with a flat upper surface, the frame comprising opposed flat plates positioned on the flat upper surface of the foundation sidewalls and a downwardly extending flange plate running along the flat plate and having one or more through openings in the flange plate, the flat plate having an upper surface and a lower surface;

one or more door leafs hinged to the frame by a hinge for movement between an elevated open position and a closed position;

a bracket mounted on the frame having one or more spaced pivot pin through openings therein for accommodating a pivot pin and one or more fastener through openings that extend through the bracket and communicate with the openings in the flange plate;

a fastener passing through the fastener through opening in the bracket and the through opening in the flange plate and engaging the vertically angled foundation sidewall of the opening; and a pressure device having a rod rotatably coupled to a pivot pin through opening in the bracket and a cylinder rotatably coupled to the door leaf, the pressure device resiliently urging the door leaf to its open position.

6. The horizontal door assembly of claim 5 wherein a resilient bumper on the hinge rests against the lower surface of the flat plate of the frame when the door leaf is in the open position.

7. The horizontal door assembly of claim 6 wherein the bumper is EPDM.

8. The horizontal door assembly of claim 5 wherein the door leaf or flange plate have threaded stud connectors for securing the hinges or brackets.

* * * * *